US006551162B1

(12) United States Patent
Pruet et al.

(10) Patent No.: US 6,551,162 B1
(45) Date of Patent: Apr. 22, 2003

(54) METHOD FOR MANUFACTURING A PHOTOCATHODE

(75) Inventors: James D. Pruet, Garland, TX (US); David G. Couch, Kaufman, TX (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 10/188,839

(22) Filed: Jul. 2, 2002

Related U.S. Application Data

(62) Division of application No. 09/399,427, filed on Sep. 20, 1999, now Pat. No. 6,440,264.

(51) Int. Cl.[7] ..... H01J 9/00

(52) U.S. Cl. ..... 445/50; 445/51; 216/45; 216/83

(58) Field of Search ..... 445/50, 51; 156/345.21, 156/345.27, 345.28; 118/407, 505; 313/103–105, 527, 528, 542; 216/45, 83

(56) References Cited

U.S. PATENT DOCUMENTS

| | | | | |
|---|---|---|---|---|
| 3,897,324 A | 7/1975 | Del Monte | ..... | 118/505 |
| 4,978,567 A | 12/1990 | Miller | ..... | 118/725 |
| 5,650,042 A | 7/1997 | Ogura | ..... | 156/655.1 |
| 6,059,622 A | 5/2000 | Pruet | ..... | 445/1 |
| 6,146,229 A | 11/2000 | Smith | ..... | 445/46 |
| 6,251,542 B1 | 6/2001 | Tomita | ..... | 216/45 |

OTHER PUBLICATIONS

Webster's New Collegiate Dictionarey, Merriam–Webster, pp. 29, 378, 885, 995, 1975.

*Primary Examiner*—Richard Bueker
(74) *Attorney, Agent, or Firm*—Baker Botts L.L.P.

(57) ABSTRACT

A method for manufacturing a photocathode includes positioning the photocathode on a support such that an etch surface of the photocathode faces away from the support. The method includes inserting an end of the support containing the photocathode into a cap. The cap comprises a passage operable to direct an etch compound to the etch surface of the photocathode. The method also includes aligning the etch surface of the photocathode with the passage of the cap using the support. The method also includes inserting a plunger through a passage in the support to contact a surface of the photocathode opposite the etch surface of the photocathode. The method further includes securing the photocathode against the cap using the plunger to confine the etch compound to the etch surface of the photocathode.

12 Claims, 2 Drawing Sheets

METHOD FOR MANUFACTURING A PHOTOCATHODE

CROSS REFERENCE TO RELATED APPLICATIONS

This application is a divisional of U.S. patent application Ser. No. 09/399,427, filed Sep. 20, 1999, now U.S. Pat. No. 6,440,264, by James D. Pruet and David G. Couch and entitled "Method and System for Manufacturing a Photocathode."

TECHNICAL FIELD OF THE INVENTION

This invention relates in general to the field of electrio-optics and, more particularly, to a method and system for manufacturing a photocathode.

BACKGROUND OF THE INVENTION

There are numerous methods and systems for detecting radiation. In one type of detector, photocathodes are used in conjunction with microchannel plates (MCPs) to detect low levels of electromagnetic radiation. Photocathodes emit electrons in response to exposure to photons. The electrons can then be accelerated by electrostatic fields toward a microchannel plate. A microchannel plate is typically manufactured from lead glassland has a multitude of channels, each one operable to produce cascades of secondary electrons in response to incident electrons. A receiving device then receives the secondary electrons and sends out a signal responsive to the electrons. Since the number of electrons emitted from the microchannel plate is much larger than the number of incident electrons, the signal produced by the device is stronger than it would have been without the microchannel plate.

One example of the use of a photocathode with a microchannel plate is an image intensifier tube. The image intensifier tube is used in night vision devices to amplify low light levels so that the user can see even in very dark conditions. In the image intensifier tube, a photocathode produces electrons in response to photons from an image. The electrons are then accelerated to the microchannel plate, which produces secondary emission electrons in response. The secondary emission electrons are received at a phosphor screen or, alternatively, a charge coupled device (CCD), thus producing a representation of the original image.

Another example of a device that uses a photocathode with a microchannel plate is a scintillation counter used to detect particles. High-energy particles pass through a scintillating material, thereby generating photons. Depending on the type of material used and the energy of the particles, these photons can be small in number. A photocathode in conjunction with a microchannel plate can be used to amplify the photon signal in similar fashion to an image intensifier tube. The detector can thus be used to detect faint particle signals and to transmit a signal to a device, e.g., a counter, that records the particle's presence.

The photocathode may include one or more layers of material deposited or grown on a surface of the photocathode to provide anti-reflection properties, filtering properties, electron transportability properties, and other suitable properties associated with the photocathode. After the layers have been deposited or grown on the surface of the photocathode, the layers generally require selective etching to reduce the layer to a thickness to provide the desired photocathode properties. For example, etch solutions such as hydrochloric acid may be applied to the layer for a predetermined time period to reduce the thickness of the layer a required amount.

Various fixtures may be used to retain the photocathode during the etching process. For example, one such fixture that has been used in the past includes a cylindrical housing having openings at each end. A first end of the housing defines a passage for directing an etch compound to an etch surface of the photocathode. The etch surface of the photocathode may be seated against an angled seating surface of the housing. The fixture may also include a base to threadably engage the housing and apply a force to the photocathode to seal the etch surface of the photocathode against the angled seating surface and align the etch surface of the photocathode with the passage of the housing. The base may also have a recess formed in an end thereof to receive the photocathode and help align the etch surface with the passage of the housing.

However, prior systems and methods for manufacturing a photocathode suffer several disadvantages. For example, misalignment of the etch surface of the photocathode with the passage of the insert may result in the etch compound flowing beyond the etch surface of the photocathode. Additionally, the base may not adequately secure the photocathode against the insert, thereby allowing the etch compound to travel beyond the etch surface of the photocathode. As a result, the etch compound may cause material removal from adjacent portions of the photocathode and/or may cause subsequent photocathode material processing difficulties.

SUMMARY OF THE INVENTION

Accordingly, a need has arisen for a better technique having greater flexibility and adaptability for manufacturing a photocathode. In accordance with the present invention, a system and method for manufacturing a photocalthode is provided that substantially eliminates or reduces disadvantages and problems associated with previously developed systems and methods.

According to one embodiment of the present invention, a system for manufacturing a photocathode includes a cap comprising a first end and a second end. The first end defines a passage operable to direct an etch compound to an etch surface of the photocathode. The system also includes a support operable to releasably engage the cap to align the etch surface of the photocathode with the passage of the cap. The system further includes a plunger operable to extend through a passage in the support to secure the photocathode against the cap to confine the etch compound to the etch surface of the photocathode.

According to another embodiment of the present invention, a method for manufacturing a photocathode includes positioning the photocathode on a support such that an etch surface of the photocathode faces away from the suppport. The method includes inserting an end of the support containing the photocathode into a cap. The cap comprises a passage operable to direct an etch compound to the etch surface of the photocathode. The method also includes aligning the etch surface of the photocathode with the passage of the cap using the support. The method also includes inserting a plunger through a passage in the support to contact a surface of the photocathode opposite the etch surface of the photocathode. The method further includes securing the photocathode against the cap using the plunger to confine the etch compound to the etch surface of the photocathode.

The technical advantages of the present invention include providing a system for manufacturing a photocathode that provides increased reliability during an etch process of the photocathode. For example, according to one aspect of the present invention, the base includes a seating area to align the etch surface of the photocathode with the passage of the insert to prevent misalignment of the photocathode during the etch process.

Another technical advantage of the present invention includes increased seal integrity between the photocathode and the insert. For example, according to one aspect of the present invention, a plunger extends through a passage in the base to secure the photocathode against the insert. The plunger includes a greater moment arm to exert an increased pressure against the photocathode to seal the photocathode against the insert, thereby preventing the etch compound from traveling beyond the etch surface of the photocathode.

Other technical advantages of the present invention will be readily apparent to one skilled in the art from the following figures, descriptions, and claims.

BRIEF DESCRIPTION OF THE DRAWINGS

For a more complete understanding of the present invention, and the advantages thereof, reference is now made to the following descriptions taken in connection with the accompanying drawings, in which.

DETAILED DESCRIPTION OF THE DRAWINGS

Embodiments of the present invention and the advantages thereof are best understood by referring to the following description and drawings, wherein like numerals are used for like and corresponding parts of the various drawings.

Figure 1:
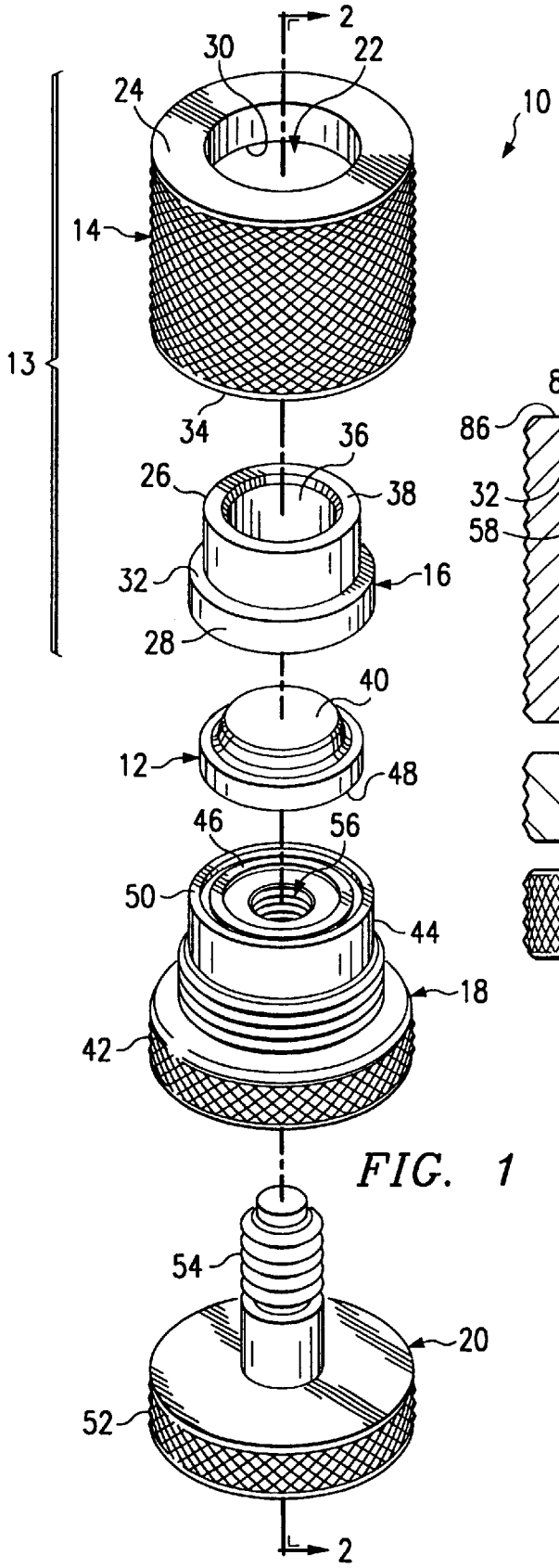
FIG. 1 is an exploded assembly diagram illustrating a system for manufacturing a photocathode in accordance with an embodiment of the present invention.

FIG. 1 illustrates a system 10 for manufacturing a photocathode 12 in accordance with an embodiment of the present invention. System 10 includes a cap 13 comprising a housing 14 and an insert 16. System 10 also includes a support 18 and a plunger 20. Housing 14 of cap 13 comprises a passage 22 defined by a flange 24 for receiving an end 26 of insert 16. Flange 24 engages a corresponding flange 28 of insert 16 to secure insert 16 within housing 14.

For example, flange 24 of housing 14 includes an internal seating area 30 to engage a corresponding seating area 32 of flange 28. Thus, in operation, insert 16 is positioned within housing 14 by sliding end 26 of insert 16 into an end 34 of housing 14 until seating area 32 engages seating area 30. Thus, flanges 24 and 28 cooperate to secure insert 16 within housing 14. Insert 16 also comprises a passage 36 defined by a surface 38 of insert 16 to direct an etch compound to an etch surface 40 of photocathode 12. In the embodiment illustrated in FIG. 1, cap 13 comprises housing 14 and insert 16 to facilitate repair and/or replacement of cap 13; however, cap 13 may also be constructed as a single unit.

Support 18 comprises a base 42 and an upstanding member 44. Upstanding member 44 comprises a seating area 46 configured to receive a seating surface 48 of photocathode 12. In operation, photocathode 12 is positioned on seating area 46, and an end 50 of support 18 is inserted into end 34 of housing 14. As support 18 is inserted into housing 14, seating area 46 aligns etch surface 40 of photocathode 12 with passage 36 of insert 16.

Plunger 20 comprises a base 52 and an upstanding member 54. In operation, upstanding member 54 is inserted through a passage 56 of support 18 to exert a force against seating surface 48 of photocathode 12 to secure photocathode 12 against insert 16. Plunger 20, support 18, and insert 16 may be constructed from Teflon to provide chemical resistance to etch compounds and prevent scratching photocathode 12; however, other suitable chemically resistive and non-scratching materials may also be used to construct plunger 20, support 18, and insert 16.

Figure 2:
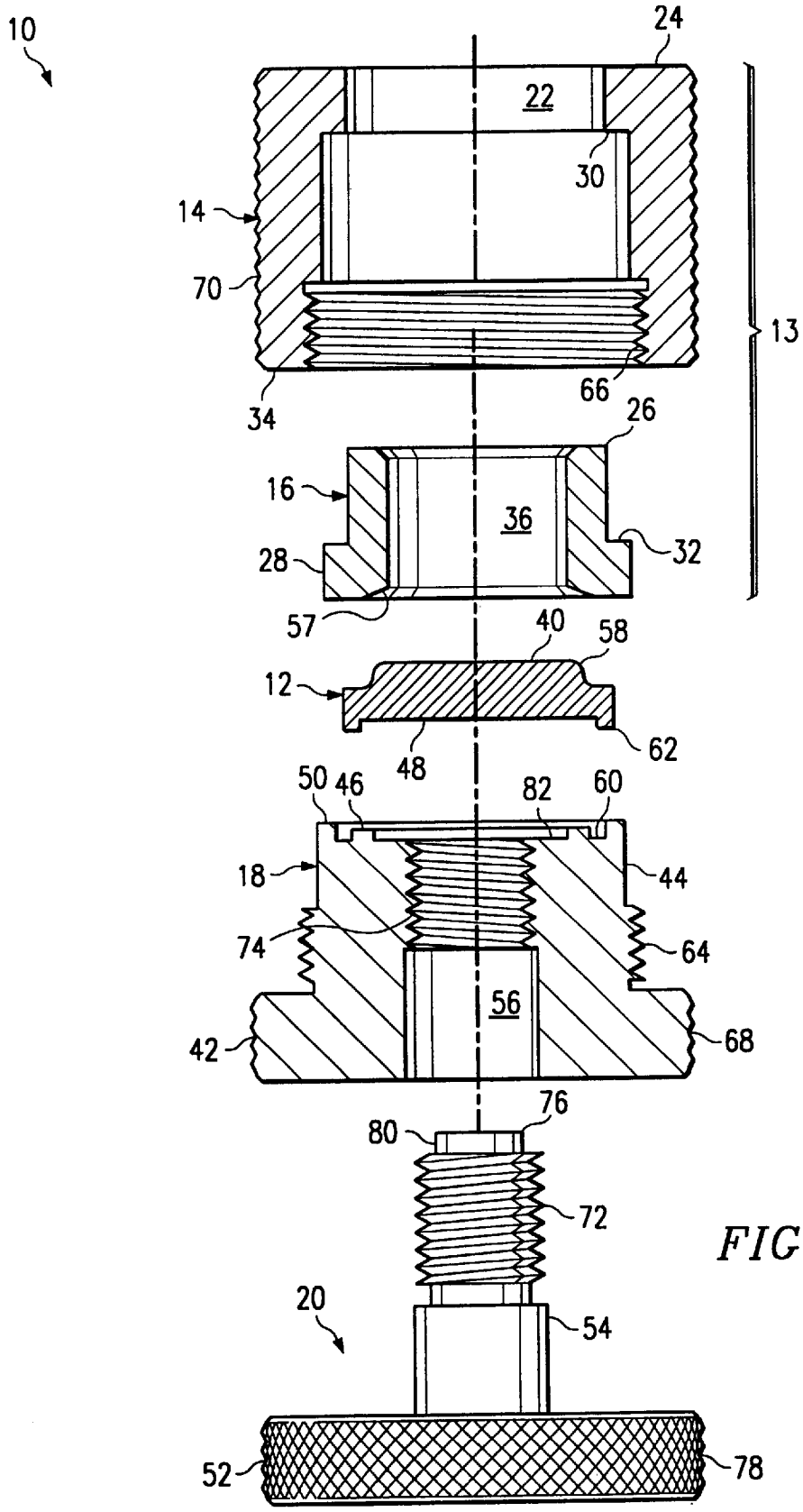
FIG. 2 is an exploded section diagram of the system illustrated in FIG. 1 taken along the line 2—2 of FIG. 1.

FIG. 2 is an exploded section diagram of system 10 illustrated in FIG. 1 taken along the line 2—2 of FIG. 1. As illustrated in FIG. 2, insert 16 also comprises a seating area 57 to engage a portion 58 of photocathode 12 bordering etch surface 40 of photocathode 12. In the embodiment illustrated in FIG. 2, seating area 57 comprises an angled seating surface; however, other suitable configurations may be used to provide a seal between insert 16 and portion 58 of photocathode 12 bordering etch surface 40.

In the embodiment illustrated in FIG. 2, seating area 46 of support 18 comprises a circular recess 60 to engage a corresponding circular projection 62 disposed on seating surface 48 of photocathode 12. However, seating area 46 may include other suitable configurations to accommodate various configurations of photocathode 12 to align photocathode 12 within housing 14. Upstanding member 44 of support 18 comprises externally formed threads 64 to engage corresponding internally formed threads 66 of housing 14. Thus, support 18 may releasably engage housing 14 to secure photocathode 12 within housing 14. Base 42 of support 18 may also include a knurled surface 68 formed on the exterior circumference of base 42, and housing 14 may include a knurled surface 70 formed on the exterior circumference of housing 14, to facilitate engaging threads 64 of support 18 with threads 66 of housing 14.

Upstanding member 54 of plunger 20 comprises externally formed threads 72 to engage corresponding internally formed threads 74 of support 18. In operation, upstanding member 54 extends through passage 56 of support 18, and threads 72 of plunger 18 releasably engage threads 74 of support 18. As upstanding member 54 extends through passage 56, an end 76 of plunger 20 contacts seating surface 48 of photocathode 12 and, applies a force to photocathode 12 to seal portion 58 of photocathode 12 against seating area 57 of insert 16. Base 52 of plunger 20 may also include a knurled surface 78 formed on the exterior circumference of base 52 to facilitate engaging threads 72 of plunger 20 with threads 74 of support 18.

End 76 of plunger 20 may also comprise a reduced diameter portion 80 and support 18 may comprise a recess 82 to ensure releasable engagement of plunger 20 and support 18. For example, overtorquing of plunger 20 or the materials used to construct plunger 20 may cause end 76 of plunger to deform as a result of the force applied to photocathode 12. Constructing plunger 20 having reduced diameter portion 80 allows any deformation of reduced diameter portion 80 to expand into recess 82 and prevent interference with threads 74 of support 18 during removal of plunger 20 from support 18. Thus, system 10 provides greater reliability than prior systems by allowing repeated assembly and disassembly of system 10. Reduced diameter portion 80 and recess 82 also provides centered contact between end 76 of plunger 20 and photocathode 12 to maintain an equalized pressure distribution between portion 58 of photocathode 12 and seating area 57 of insert 16.

Figure 3:
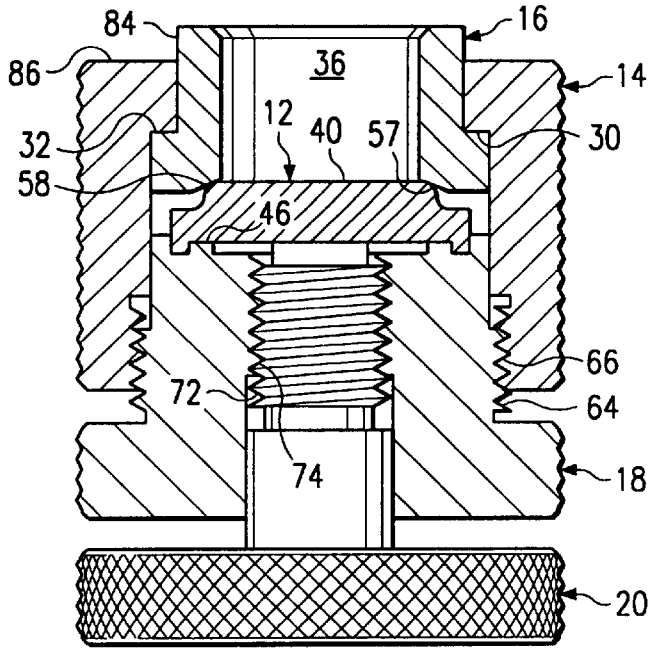
FIG. 3 is an assembled section diagram of the system illustrated in FIG. 2.

FIG. 3 is an assembled section view of system 10 illustrated in FIG. 2. As illustrated in FIG. 3, insert 16 is disposed within housing 14 such that seating area 30 of housing 14 engages seating area 32 of insert 16. Seating areas 30 and 32 secure insert 16 within housing 14 and provide support for resisting a force applied to photocathode 12 to secure photocathode 12 against insert 16. Insert 14 may also be constructed having a length such that a portion 84 of insert 14 extends above a surface 86 of housing 14 to facilitate removal of an etch compound from within passage 36 of insert 14.

In operation, photocathode 12 is positioned on seating area 46 of support 18. Support 18 may then be inserted into housing 14 by engaging corresponding threads 64 and 66. As support 18 is advanced within housing 14, seating area 46 aligns etch surface 40 of photocathode 12 with passage 36 of insert 16. Support 18 may by advanced within housing until portion 58 of photocathode 12 is seated against seating area 57 of insert. Passage 36 of insert 16 also provides visual verification of the alignment of photocathode 12 within housing 14.

After photocathode 12 is seated against seating area 57, plunger 20 may be inserted into support 18 by engaging corresponding threads 72 and 74. As plunger 20 advances within support 18, end 76 of plunger 20 contacts seating surface 48 of photocathode 12 and applies a force to seating surface 48 to seal etch surface 40 of photocathode 12 within passage 36. As illustrated in FIG. 13, plunger 20 provides an additional force to secure portion 58 of photocathode 12 against seating area 57. For example, the distance between an outer circumference of base 52 and an outer circumference of upstanding member 54 creates a greater moment arm than support 18, thereby providing an increased torsional force to secure photocathode 12 against seating area 57. Thus, system 10 provides greater integrity than prior systems by providing an increased sealing capability between photocathode 12 and insert 14.

Although the present invention and its advantages have been described in detail, it should be understood that various changes, substitutions and alterations can be made without departing from the spirit and scope of the present invention as defined by the appended claims.

What is claimed is:

1. A method for manufacturing a photocathode comprising:

positioning the photocathode on a support such that an etch surface of the photocathode faces away from the support;

inserting an end of the support containing the photocathode into a cap, the cap comprising a passage operable to direct an etch compound to the etch surface of the photocathode;

aligning the etch surface of the photocathode with the passage of the cap using the support;

inserting a plunger through a passage in the support to contact a surface of the photocathode opposite the etch surface of the photocathode; and securing the photocathode against the cap using the plunger to confine the etch compound to the etch surface of the photocathode.

2. The method of claim 1, wherein positioning the photocathode comprises positioning the photocathode on a seating area of the support, and wherein aligning the etch surface comprises aligning the seating area of the support with the passage of the cap.

3. The method of claim 1, wherein inserting an end of the support comprises releasably engaging the support with the cap.

4. The method of claim 1, wherein securing the photocathode comprises threadably engaging the plunger with the support to secure the photocathode against the cap.

5. The method of claim 1, further comprising disposing an insert within a housing to form the cap, wherein the passage of the cap is formed in the insert.

6. The method of claim 1, further comprising engaging a seating surface of the cap with a portion of the photohathode bordering the etch surface.

7. A method for manufacturing a photocathode comprising:

providing a cap having a first end and a second end, the first end including a passage;

positioning the photocathode on a seating area of a support;

releasably engaging the support with the cap to align an etch surface of the photocathode with the passage of the first end of the cap;

extending a plunger through a passage in the support;

engaging an end of the plunger with the photocathode; and securing, with the end of the plunger, the photocathode against the cap to confine an etch compound to the etch surface of the photocathode.

8. The method of claim 7, wherein the cap comprises a seating surface and further comprising engaging the seating surface with a portion of the photocathode bordering the etch surface.

9. The method of claim 7, further comprising providing the support with a recess for receiving the photocathode and aligning the etch surface of the photocathode with the passage of the first end of the cap.

10. The method of claim 7, wherein extending the plunger through the passage in the support comprises threadably engaging the plunger with the passage of the support.

11. The method of claim 7, wherein securing, with the end of the plunger, the photocathode against the cap comprises engaging a surface of a reduced diameter portion of the plunger with the photocathode opposite the etch surface.

12. The method of claim 11, further comprising providing the support with a recess to facilitate deformation relief of the reduced diameter portion.

* * * * *